US007637506B2

(12) United States Patent
Naicker

(10) Patent No.: US 7,637,506 B2
(45) Date of Patent: Dec. 29, 2009

(54) BLACKJACK TOURNAMENTS WITH RULES ENCOURAGING CARD COUNTING AND BROADCASTS THEREOF

(75) Inventor: Theo Naicker, Durban (ZA)

(73) Assignee: Waterleaf Limited, Douglas, Isle of Man (GB)

( * ) Notice: Subject to any disclaimer, the term of this patent is extended or adjusted under 35 U.S.C. 154(b) by 16 days.

(21) Appl. No.: 11/521,967

(22) Filed: Sep. 14, 2006

(65) Prior Publication Data

US 2008/0067743 A1 Mar. 20, 2008

(51) Int. Cl.
*A63F 1/00* (2006.01)
*A63F 9/20* (2006.01)

(52) U.S. Cl. ..... 273/292; 273/303; 273/309; 463/11; 463/12; 463/13

(58) Field of Classification Search ..... 273/292, 273/149; 463/12, 28
See application file for complete search history.

(56) References Cited

U.S. PATENT DOCUMENTS

| | | | | |
|---|---|---|---|---|
| 5,374,061 | A | 12/1994 | Albrecht | 273/149 R |
| 5,397,133 | A | 3/1995 | Penzias | 463/22 |
| 5,451,054 | A | 9/1995 | Orenstein | 273/148 |
| 5,603,502 | A | 2/1997 | Nakagawa | 273/292 |
| 5,735,525 | A | 4/1998 | McCrea, Jr. | 273/309 |
| 6,902,166 | B2 * | 6/2005 | Stern | 273/292 |
| 2002/0155872 | A1 * | 10/2002 | Odom et al. | 463/13 |
| 2002/0165029 | A1 | 11/2002 | Soltys et al. | 463/47 |
| 2004/0100025 | A1 * | 5/2004 | Conklin et al. | 273/292 |
| 2004/0160009 | A1 * | 8/2004 | Vancura et al. | 273/292 |
| 2005/0062226 | A1 * | 3/2005 | Schubert et al. | 273/149 R |
| 2005/0173862 | A1 | 8/2005 | Orenstein | 273/292 |
| 2005/0227760 | A1 * | 10/2005 | Vlazny et al. | 463/28 |
| 2006/0128453 | A1 * | 6/2006 | Hoffman | 463/12 |
| 2006/0199649 | A1 | 9/2006 | Soltys et al. | 463/47 |
| 2006/0279045 | A1 * | 12/2006 | Thomas et al. | 273/292 |

FOREIGN PATENT DOCUMENTS

| | | |
|---|---|---|
| WO | WO 03/093921 | 11/2003 |
| WO | WO 2004/112923 | 12/2004 |

OTHER PUBLICATIONS

Edward Thorp, "A Favorable Strategy for Twenty-One", Proc. N.A.S. pp. 110-112 (1962).

(Continued)

*Primary Examiner*—Gene Kim
*Assistant Examiner*—Michael D Dennis
(74) *Attorney, Agent, or Firm*—McDonnell Boehnen Hulbert & Berghoff LLP

(57) ABSTRACT

Blackjack tournaments are described which provide for rules and practices that facilitate counting of cards by players, such as dealing from a single deck of 52 cards down to the last card in the deck. The proprietor of the tournament limits its exposure to losses by forming a pool of prize money from entrance fees paid by players, sponsorship fees, a limited contribution to the pool of prize money, or combinations thereof. Players play with chips provided by the proprietor of the tournament. The tournament may be captured with one or more video cameras and broadcast over an entertainment network. The broadcast may feature card counting reports, commentary by experts, and a display of the sequence of cards to be dealt to the players and the dealer.

11 Claims, 3 Drawing Sheets

OTHER PUBLICATIONS

Edward Thorp, "Beat the Dealer", Vintage Books, 2nd Edition (1966).

www.worldseriesofpoker.com web pages (2006).

Donald Catlin, Black Jack Tournament Play: What's Luck Got to Do With It?, Casino City Times, Aug. 2, 2005, downloaded from the World Wide Web from http://catlin.casinocitytimes.com/articles/6158.html.

Stanley Sludikoff, Blackjack Encyclopedia of Casino Twenty-One: Gambling Times, Gambling Times Magazine, May 30, 2001, downloaded from the World Wide Web from http://www.bjrnet.com/member/bjapr/Pubs_GT.htm.

Chuck Greene, Where to Play Single-Deck Blackjack, Winner Online.Com, Apr. 10, 2001, downloaded from the World Wide Web from http://www.winneronline.com/articles/april2001/singledeckblackjack.htm.

QFIT, Casino Vérité Blackjack—Shuffle Tracking & Ace Sequencing Software—CVShuffle, Feb. 12, 2005, downloaded from the World Wide Web from http://web.archive.org/web/20050212031215/http://www.qfit.com/shuffle-tracking.htm.

John Grochowski, Take this blackjack quiz to learn something about the game, The Detroit News, detnew.com, Casino Guide, Mar. 3, 2005, downloaded from the World Wide Web from http://info.detnews.com/casino/newdetails.cfm?column=grochowski&myrec+267.

Blackjack 21, BlackJack 21 News, May 29, 2006, downloaded from the World Wide Web from http://www.blackjack21.net.

Ken Smith, Pharaoh's Single Deck, Hour 1 of 10, Ken Smith's Blackjack Blog, Jul. 22, 2005, downloaded from the World Wide Web from http://www.blackjackinfo.com/blog/2005/07/pharaohs-single-deck-hour-1-of-10.htm.

Extended European Search Report in EP Application No. 07253648.5, dated Jan. 30, 2008.

U.S. Appl. No. 11/522,134, filed Sep. 14, 2006.

European Search Report in EP Application No. 072553661.8, dated Jun. 10, 2008.

* cited by examiner

| 102 CARD | 104 LEFT IN DECK |
|---|---|
| 2 | ▨ ▨ ▨ ▨ |
| 3 | ▨ ▨ ▨ |
| 100 → 4 | ▨ ▨ |
| 5 | ▨ ▨ ▨ |
| 6 | ▨ |
| 7 | — |
| 8 | ▨ |
| 9 | ▨ ▨ ▨ ▨ |
| 10'S | ▨ ▨ ▨ ▨ ▨ ▨ ▨ |
| A | ▨ ▨ |

Fig. 3
100
| 120 SYSTEM | 122 RUNNING COUNT | 124 SIDE COUNT | 126 TRUE COUNT (SC TRUE COUNT) |
|---|---|---|---|
| K-0 | +3 | — | — |
| HIGH-LOW | +2 | +1 | +3 (+2) |
Fig. 4
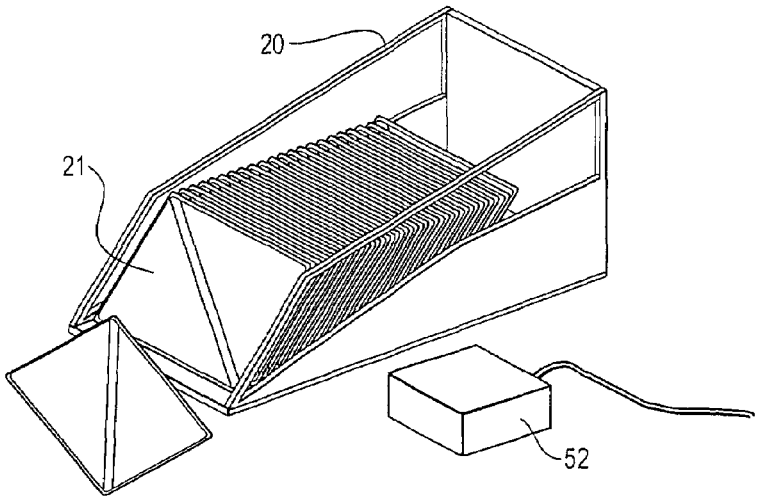
Fig. 5
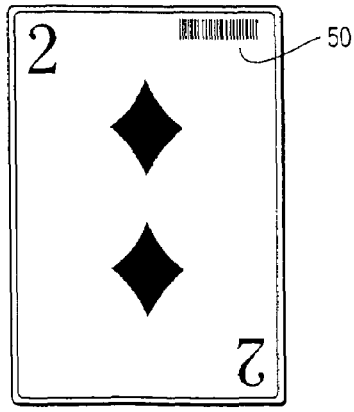

BLACKJACK TOURNAMENTS WITH RULES ENCOURAGING CARD COUNTING AND BROADCASTS THEREOF

FIELD

This disclosure relates generally to the field of card games and more particularly to the game of blackjack, tournaments featuring blackjack, and broadcasts of blackjack tournaments.

BACKGROUND

The game of blackjack, also known as twenty-one ("21"), is a popular wager game played with one or more standard decks of playing cards. The rules of blackjack are described in the game literature and will not be detailed here. The rules also vary slightly depending on the casino or country where the game is played. Suffice it to say that, in most forms of the game, the player makes a wager and then receives two cards face down from a dealer. The dealer receives two cards, one face down and the other face up. The player then elects to either receive one or more cards from the dealer or retains the cards he has, hoping that the sum of the point count for the cards in his hand does not exceed 21. The dealer follows fixed rules as to whether to sit on its two cards or receive one or more additional cards. If the player does not "bust" (the sum of the point count of cards in his hand exceeds 21) but the dealer busts, then the player wins, e.g., an amount equal to the amount wagered. If the player busts, the player loses his wager. If neither the player nor the dealer bust, then if the sum of the point count of the player's hand is greater than that of the dealer, the player wins. If there is a tie, the player's wager is returned. If the dealer's hand is closer to 21 than the player, the player loses. Aces can be counted as either 1 or 11.

In general, the house (dealer) has a slight advantage over the player at blackjack under the rules governing play at all casinos. Therefore, casinos can offer blackjack as wager game in which it may lose money to some players, but in the long run the casino will make money on the enterprise.

Blackjack's popularity stems, at least in part, from the great mystique associated with systematic ways of playing the game to minimize the house advantage. In the early 1960's, a mathematician and university professor, Edward O. Thorp, used a computer to analyze the game of blackjack and discovered a set of rules for systematically playing the game of blackjack. Thorp's system takes into account the point value of cards which are exposed to the player during the course of play. If the game is played in accordance with rules developed by Thorp, the house advantage can not only be negated, but actually turned into an advantage for the player. Thorp's book "Beat the Dealer", second edition, Vintage Books (1966), has emerged as a classic text on blackjack and card counting. The book includes several accounts of Thorp, and others using his system, making large sums of money playing blackjack at casinos.

Card counting techniques, of which there are several explained in Thorp's book, essentially are techniques by which the player obtains a strategy for determining whether to receive an additional card or cards as a result of noting or counting cards from the deck which have been revealed to the player as a result of having been dealt to the player, dealt face up to the dealer, or dealt to other players. Depending on the cards that have been revealed, the advantage (i.e., statistical probability that a player will beat the dealer using the card counting technique) may swing to the dealer, or to the player, sometimes strongly so. An example of where the player may have a strong advantage is when the game is played from a single deck of 52 cards and the cards are dealt down to the last card. Using Thorp's card counting techniques, the player can determine when a player has an advantage, or when the dealer has an advantage. When the advantage is to the player and particularly strongly so (a situation detectable using Thorp's card counting methods), the player places a large wager. Conversely, when the advantage is to the dealer, the player places a small or minimum wager. Over the long term, card counting allows the player to gain a statistical advantage over the dealer. The player will profit from his play, provided that Thorp's methods are rigidly adhered to, the player places large or small wagers in accordance with Thorp's rules, and also provided that the rules are not changed during play and the dealer does not cheat.

Although card counting adds to blackjack's popularity, because it works to negate the house edge, casinos, and establishments more generally, have actively discouraged card counting techniques in order to not lose money by offering blackjack. To minimize the ability for card counters to accurately count, for example, establishments enforce rules that tend to minimize a player's ability to count cards. For example, the establishments engage in practices such as increase the number of decks of cards that are used in the blackjack card shoe, shuffle the "spent" cards with the cards still left in the shoe regularly or after every hand, remove certain features of the game such as surrender and doubling, and even prevent known card counters from entering the given establishment or asking them to leave once discovered. It is estimated that casinos spend large sums to prevent card counting and to catch card counters.

Thus, while the prior art recognizes that card counting can be a successful technique for beating the dealer at blackjack, the art also teaches that casinos should take steps to prevent card counting in order to retain the house advantage.

This disclosure presents a distinct departure from the prior art, as it describes blackjack tournaments, suitable for offering in a casino establishment, in which card counting is not only tolerated but actually encouraged. In particular, the tournaments are conducted in accordance with one or more rules of play that are designed to facilitate counting of cards by card counters, such as dealing from a single deck of 52 cards down to the last card. The more proficient a player is at the methods of Professor Thorp, or at newer or even better card counting methods, the better the player can expect to do at the tournament. Accordingly, tournaments in accordance with aspects of the present disclosure might well be advertised under the banner "Card Counters Welcome!" Conversely, usage of such a banner at a blackjack establishment today in most circumstances would be virtually unthinkable because such establishments intentionally try to frustrate card counting.

SUMMARY

In a first aspect, a method is described for conducting a blackjack tournament which avoids a risk of large losses to the proprietor of the tournament due to card counting. The method combines blackjack game rules which are favorable for card counters with high tournament prize money in order to encourage card counters to participate in the blackjack tournament.

In particular, the method includes a step of forming a pool of prize money for paying out to one or more winners of the tournament. The pool of prize money could be formed from entrance fees paid by one or more players playing in the tournament. The pool of prize money may be augmented with sponsorship money from sponsors, e.g., hotels, casinos, television networks, car companies or other advertisers, or other parties. The sponsor of the tournament could also contribute to the pool of prize money.

The method further includes a step of providing a set of rules for playing rounds of blackjack at the tournament wherein the rules are favorable to counting of cards by the players. Several examples of such favorable rules are disclosed herein.

The method further includes a step of conducting rounds of play of blackjack using the set of rules wherein during the rounds of play the players in the tournament make wagers and receive winnings with chips provided by the proprietor of the tournament to the players. Unlike blackjack played in a casino where the player's winnings are paid by the house, the proprietor of the tournament is not exposed to losses due to card counting by players playing in the tournament, since the reward for winning the tournament is paid out from the pool of prize money. Thus, card counting by the players playing in the tournament may be encouraged since the proprietor of the tournament is not at risk.

The set of rules in place during the tournament are favorable to card counting. Such rules may include playing blackjack at each of the tables used in the tournament using a single deck of 52 cards and dealing the cards from the deck down to the last card in the deck. Alternatively or additionally, the set of rules may include a rule of exposing all the cards of the players at each table to all the players at the table after each hand of play. As another example, the set of rules may include a rule of exposing the cards of players who bust during play.

Blackjack tournaments in accordance with the methods of this invention are ideally suitable for broadcasting on television or other entertainment networks (e.g., the Internet or cable TV networks) as entertainment for card players, thereby popularizing the tournament, attracting more players to casinos to play blackjack, and encouraging card counters to participate in future tournaments. Thus, the method may further include the step of broadcasting the play of the tournament over an entertainment network. Such broadcasts may optionally include features to provide the viewers with an "inside" look at the game, including identifying the sequence of cards yet to be dealt to players and the dealer during play and including the sequence in the broadcasting of the play, and providing a card counting report in the broadcast of the play. The current card counting report can take a variety of forms, such as showing the distribution of the remaining cards in the deck, a + or − score or index using the high/low index system explained in Chapter 7 of Thorp's book; the current ratio of tens to others as explained in Chapter 8 of Thorp's book, a table showing the ideal strategy given the current status of cards previously revealed, or otherwise. As a further feature, the broadcasting of the tournament may be accompanied by play commentary by one or more experts in the game of blackjack.

In another aspect of this disclosure, the invention can be considered as a novel arrangement of blackjack tournament apparatus comprising, in combination, a facility hosting a tournament of blackjack, the facility including one or more tables where blackjack may be played; one or more video cameras for capturing play at least one of the one or more tables for broadcast to an audience remote from the facility; wherein the tournament is characterized in that a pool of prize money is formed for paying out to one or more winners of the tournament, e.g., at least in part from entrance fees paid by one or more players playing in the tournament or from sponsors; a set of rules is provided for play at the tournament for playing rounds of blackjack at the tournament wherein the rules include one or more rules favorable to counting of cards in a systematic method for playing blackjack; and wherein rounds of play of blackjack are conducted at the tables using the set of rules wherein during the rounds of play the players make wagers and receive winnings with chips provided by the proprietor of the tournament to the players, whereby the proprietor of the tournament is not exposed to losses due to card counting by players playing in the tournament and card counting by the players may be encouraged.

The blackjack tournament broadcast may optionally include an identification of the sequence of the cards remaining in a deck of cards used at one of the tables; and/or a card counting report, and/or commentary by one or more experts in the game of blackjack.

The blackjack tournament apparatus may further include a card sequence identifying apparatus for determining the sequence of cards to be dealt by a dealer to players at one of the tables. The apparatus may take several forms as described herein, including a machine readable code applied to the cards to be dealt by a dealer and a reader for the code. When the sequence of cards is known using the apparatus, the broadcast may include presentation of the card sequence to the viewers of the broadcast as an additional entertainment feature.

In still another aspect of this disclosure, television broadcast apparatus is disclosed comprising a machine readable memory storing broadcast data for transmission over an entertainment network, the broadcast data comprising data representing video of play at a blackjack tournament, a card counting report reflecting the state of a deck of cards to be dealt to players at the table in the tournament, and commentary by experts.

These and still other aspects and features of the present disclosure will be explained in the following detailed description.

BRIEF DESCRIPTION OF THE DRAWINGS

In the following discussion reference will be made to the drawings, in which:

FIG. 3 is an illustration of second example of a card counting report which may be provided in a television or broadcast of a tournament for the benefit of viewers.

FIG. 4 is an illustration of a mechanism for identifying the sequence of un-dealt cards in a shoe.

FIG. 5 is an illustration of a marker in the form of a bar code which is read by the mechanism of FIG. 5 in order to determine the sequence of un-dealt cards in the shoe of FIG. 4.

DETAILED DESCRIPTION

A. Blackjack Tournaments

Figures 1, 2:
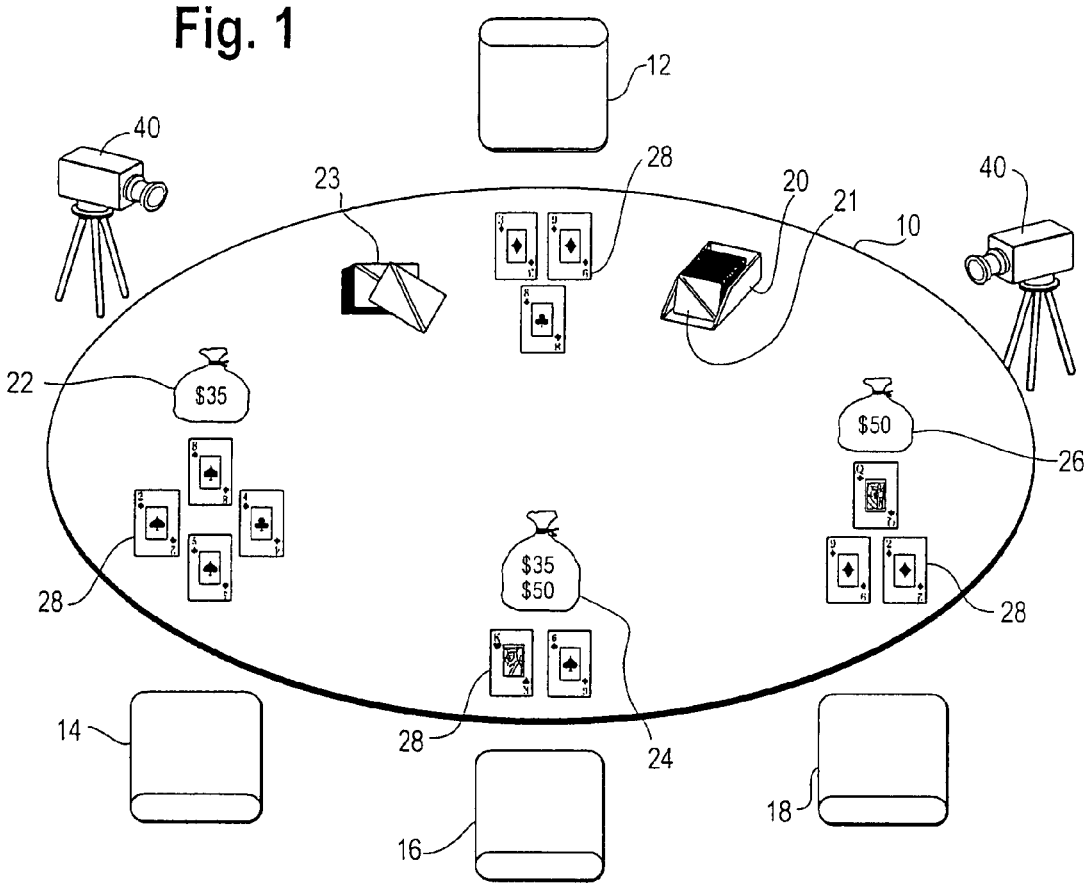
FIG. 1 is a schematic view of a blackjack table for use in the blackjack tournaments of this disclosure.
FIG. 2 is an illustration of a first example of a card counting report which may be provided in a television or other broadcast of the tournament for the benefit of viewers.

Multiplayer blackjack tournaments are described herein that are designed to facilitate and encourage players who approach the game in a systematic way and count cards to determine the best strategy for play. Currently, rules and practices for blackjack play at casinos are designed to frustrate or discourage card counters, such as rules increasing the number of decks of cards that are used in a blackjack card shoe, early shuffling of cards, i.e., reshuffling the cards while a significant proportion of the shoe (for example, a third or a half of the shoe) still remains unused, removing of certain game features that may be favorable to the player such as surrender and doubling features, and preventing known card counters from entering the blackjack establishment.

The blackjack tournaments of this disclosure preferably combine two features to attract card counters. Firstly, the tournaments features blackjack game rules and practices which are favorable for card counters. Such rules may include playing blackjack at each of the tables used in the tournament using a single deck of 52 cards and dealing the cards from the deck down to the last card in the deck. Alternatively, more than one deck could be used which is dealt down to the last card. Alternatively or additionally, the set of rules may include a rule of exposing all the cards of the players at each table to all the players at the table after each hand of play. The idea behind this rule is that as more cards are revealed, the player will have a greater idea of which cards remain in the deck and therefore obtain a more precise understanding of the correct play (e.g., whether to stand or whether to receive another card, or whether to place a large wager or a small wager). As another example, the set of rules may include a rule of exposing the cards of players who bust during play, again increasing the exposure of cards and allowing the player to obtain a greater degree of certainty as to the correct strategy as to standing, doubling, etc., and wager size. All three of these rules may be combined. Additional rules favorable to card counting may be adopted.

A second aspect of the tournament is that the tournament is structured so that the proprietor of the tournament (the entity awarding prize money to the winner) is not exposed to losses as would be expected to occur if the winnings for every hand were paid directly to the player from the house's bank account. Under the current state of the art, if no countermeasures are taken expert card counters can and will beat the dealer and will cause any casino to lose money, and potentially large sums of money. To counter this, the tournament proprietor forms a pool of prize money which is high enough in order to encourage card counters to participate in the blackjack tournament, but funds the prize money pool from some source or sources that limit or negate entirely the exposure to losses. For example, the pool of prize money could be formed from entrance fees paid by one or more players playing in the tournament. The pool of prize money could also be supplied by or augmented with sponsorship money from sponsors, e.g., hotels, casinos, television networks, car companies or other advertisers, or other parties. The sponsor of the tournament could also contribute to the pool of prize money, and thereby limit their exposure to the amount contributed to the pool.

The tournament features conducting rounds of play of blackjack using the set of rules favorable to card counting. During the rounds of play the players in the tournament make wagers and receive winnings with chips provided by the proprietor of the tournament to the players. For example, each player could receive some value of chips (say $5000 worth of chips), and the tournament has rules for the minimum and maximum wager amounts. Players are eliminated when they run out of chips or their chip total falls below a minimum level. Play continues in rounds, with players being eliminated until a final round of play occurs, and the player with the most chips after the final round wins the tournament. Variations on this general format are of course possible. However, unlike blackjack played in a casino where the player's winnings are paid by the house, the proprietor of the tournament is not exposed to losses due to card counting (beyond any amount contributed to the prize pool), since the reward for winning the tournament is paid out from the pool of prize money. Thus, card counting by the players playing in the tournament may be encouraged since the proprietor of the tournament is essentially not at risk.

A further example of a tournament will now be described. A multiplayer blackjack tournament is provided at a facility such as a casino and features one or more competition blackjack tables. There is a fixed buy-in amount and an entrance fee which is paid by each contestant. For example, if the buy-in amount is $40, and the entrance fee is $4, each player pays $44 to play. If the buy-in amount is $30, say, the entrance fee is $5; the player pays $35 to play.

The buy-in amount from all players in the tournament is pooled to form the tournament prize money. The tournament prize money may be augmented by sponsorship money from advertisers or the casino hosting the tournament. The entrance fee amount may be credited the operator of the casino to cover its costs in hosting the tournament.

Each player is awarded tournament chips at the beginning of the tournament. These chips are used as counters to determine the winner of the tournament. A player is eliminated from the tournament when the player has lost all his/her tournament chips.

The number of seats at each Blackjack table is three or five, and is configured when the tournament is set up. Each player plays against the dealer at the table, but not the house—i.e. payouts only affect a player's tournament chip balance. The contestants (players) play at a plurality of the tables simultaneously or in shifts if necessary to accommodate all the players.

The tournament consists of a number of betting rounds and each round consists of a predetermined number of hands. The number of hands for the first round is configured when the tournament is set up, the default number of hands for the first round being 30. The number of hands per round is a variable. For example, in Round 1 the number of hands is 30, and in Round 2 the number of hands may be 40. If the tournament has multiple rounds, players start each round with the same number of chips as the first round.

There is a minimum and maximum bet for each round. The minimum and maximum bet amounts may be variable per round, or fixed for all rounds of the tournament. The minimum and maximum bets are configured when the tournament is set up. The default minimum bet amount is $50.00 and the default maximum bet amount is $1,000.00 ($50.00×20). The minimum and maximum bet amounts increase per round (configured when the tournament is set up).

At the end of each round, the player at each table with the lowest number of tournament chips is eliminated and all other players proceed to the next round.

At the end of the tournament, the player with the highest number of tournament chips wins the largest share of the prize money. If two or more players tie, the winner is decided by sudden death.

As noted above, the play in each of the rounds features one or more rules for the game which are favorable to card counters, several of which were described previously. The remainder of the rules may be in accordance with standard practices, e.g., as set forth in Chapter 2 of Thorp's book. Doubling, splitting pairs, surrender, insurance and other features and variations of blackjack may optionally be provided.

B. Broadcasting of Tournaments

Blackjack tournaments in accordance with the methods of this invention are well suited for broadcasting on television or other entertainment networks (e.g., the Internet or cable TV networks) as entertainment for card players, thereby popularizing the tournament, attracting more players to casinos to play blackjack, and encouraging card counters to participate in future tournaments. Thus, the method may further include the steps of broadcasting the play of the tournament over an entertainment network.

Such broadcasts may optionally include features to provide the viewers of the broadcast with an "inside" look at the game which is not available to the players in the tournament, including providing a visual display of the sequence of cards yet to be dealt to players and the dealer during play, and providing a visual display of a card counting report in the broadcast of the play. The current card counting report can take a variety of forms, such as showing the distribution of the remaining cards in the deck, a + or − score or index using the high/low index system explained in Chapter 7 of Thorp's book "Beat the Dealer", second edition; the current ratio of tens to others as explained in Chapter 8 of Thorp's book, a table showing the ideal strategy given the current status of cards previously revealed, or otherwise. As a further feature, the broadcasting of the tournament may be accompanied by play commentary by one or more experts in the game of blackjack.

In another aspect of this disclosure, the invention can be considered as a novel arrangement of blackjack tournament apparatus. The apparatus includes a facility such as casino hosting a tournament of blackjack, the facility including one or more tables where blackjack may be played. The apparatus further includes one or more video cameras for capturing play at at least one of the tables for broadcast to an audience remote from the facility. The tournament is characterized in that a pool of prize money is formed for paying out to one or more winners of the tournament, e.g., at least in part from entrance fees paid by one or more players playing in the tournament or from sponsors. A set of rules is provided for play at the tournament for playing rounds of blackjack at the tournament wherein the rules include one or more rules favorable to counting of cards in a systematic method for playing blackjack. Rounds of play of blackjack are conducted at the tables using the set of rules wherein during the rounds of play the players make wagers and receive winnings with chips provided by the proprietor of the tournament to the players. The proprietor of the tournament is not exposed to losses due to card counting by players playing in the tournament and card counting by the players may be encouraged.

The blackjack tournament broadcast may optionally include an identification of the sequence of the cards remaining in a deck of cards used at one of the tables (either in whole or in part); and a card counting report, or commentary by one or more experts in the game of blackjack.

Turning now to the Figures, FIG. 1 is an illustration of a table 10 that may be used for play of blackjack play a tournament of this disclosure. The table 10 includes a dealer position 12, and player positions 14, 16 and 18. While three player positions are shown it will be understood that the table may accommodate a different number of players, such as 5 or more. The dealer deals cards from standard deck of 52 playing cards which are housed in a shoe 20. Each player has a pile of chips 22, 24, 26 from which to place wagers on hands of play. While the cards 28 are shown face up in FIG. 1, it will be understood that during play each player receives their initial two cards face down and cannot see the cards held by other players. Additional cards, if any, dealt to each player are dealt face up. The dealer's cards are dealt in the usual fashion, one face down and one face up, with additional cards dealt to the dealer dealt face up.

After each hand of play, players having a winning hand receive winnings in the form of additional chips from those wagered in that round of hands.

The dealer can be considered as having an infinite bankroll of tournament chips. Thus, at the end of a tournament round, it is quite possible for each player at a table to end up with a greater number of tournament chips than at the commencement of the round. The increase in tournament chips comes from the dealer's bankroll. It is worth noting again that at the commencement of each round of play all the players have the same number of tournament chips.

After each hand of play, "spent" cards 23 are collected on the side. The next hand of play continues and each player is dealt two cards face down and the dealer receives one card face down and another card face up. Play continues as before. The dealer continues to deal from the deck of cards 21 in the shoe until the last card in the deck is deal, all the "spent" cards are gathered up, reshuffled, placed in the shoe and play then continues. The process repeats at the table until players run out of chips at which point they are eliminated from the competition, or the round of play ends. At the end of the round, any players without a minimum number of chips are eliminated. Alternatively, the player(s) with the lowest amount of chips at each table are eliminated. Players advance to subsequent rounds, are gradually eliminated, and the rounds continued until a winner emerges.

Players are not allowed any aids for counting cards and must rely solely on their memory, their knowledge of their card counting system, and ability to quickly apply the system. Play is also not delayed unduly to give a player time to work out the correct play according to their system.

If the tournament is to be broadcast, the table 10 features one or more video cameras 40. Such cameras 40 are strategically placed to capture all the play at the table, Additional cameras could be placed adjacent to the dealer's hands and the player's hands to capture the cards which are dealt to the players for the benefit of the viewer. Alternatively, the cards dealt to the players could be determined by means of a card identifying mechanism incorporated into the shoe and described subsequently in FIGS. 4 and 5.

When the tournament is broadcast to viewers, the broadcast could be accompanied with a display of a card counting report in order to illustrate the state of the deck of cards, the probabilities facing the players, the correct strategy, etc, in order to stimulate further interest in the tournament. The format of the card counting report can take any variety of forms, two of which are shown in FIGS. 2 and 3. In FIG. 2, the card counting report 100 consists of a table of two columns. The left hand column 102 shows the point value of cards in the decks (Tens, Jacks, Queens and Kings are all scored 10, Aces are scored 1 or 11 and are shown merely as Aces). The right hand column 104 shows a distribution of each point value remaining in the deck. For example, at some given state of play the deck may contain four Twos, three Threes, no Sevens, etc. as shown in FIG. 2.

In FIG. 3 the card counting report 100 takes the form of a table showing card counting scores or indexes in various card counting systems that are currently popular. For example, the table includes a column 120 which identifies the system, and a second column 122 that gives the running count in that system. A third column 124 includes a running count in a side count, and a fourth column 126 that provides a still further count in the system, which may incorporate or depend from the counts in the other columns. A dashed line in FIG. 3 indicates that the count or index is not used in the system. While only two systems are shown in FIG. 3 (K-O and High-Low), the report of FIG. 3 may include any arbitrary number of systems.

It will be understood that the card counting reports of FIGS. 2 and 3 are offered by way of example only and not limitation and other formats for card counting reports are of course possible. Furthermore, the card counting reports may be shown displayed in conjunction with the video of play in any convenient manner, e.g., to the side of the video of play, as a scrolling text on the bottom margin of the display, or in any other format.

As a further feature for the viewer, the broadcast of the tournament may feature the sequence of cards which remain to be dealt to the players and the dealer, such sequence of course not being available to the players or the dealer. To determine such sequence, the tables at the tournament have some means for identifying the sequence of the cards in the deck. The means for identifying the cards could be incorporated into the shoe from which the cards are dealt. One example is shown in FIG. 4. The shoe 20 contains initially a deck of fifty two cards 21. Each card 21 is provided with a bar code 50 (FIG. 5) which appears on the face of the card. When the cards 21 are placed in the shoe, each of the cards is positioned one at a time adjacent to a bar code reader 52 which reads the bar code 50 on the face of the card. Thus, the reader will read each card in sequence and send the sequence of cards to a computer which is used to generate card data for the broadcast of the tournament. While a bar code and bar code reader are shown in FIGS. 4 and 5, other mechanisms may be used, such as incorporating the bar code reader into the table 10 (FIG. 1) and passing the cards over the reader prior to loading the cards into the shoe.

Figure 6:
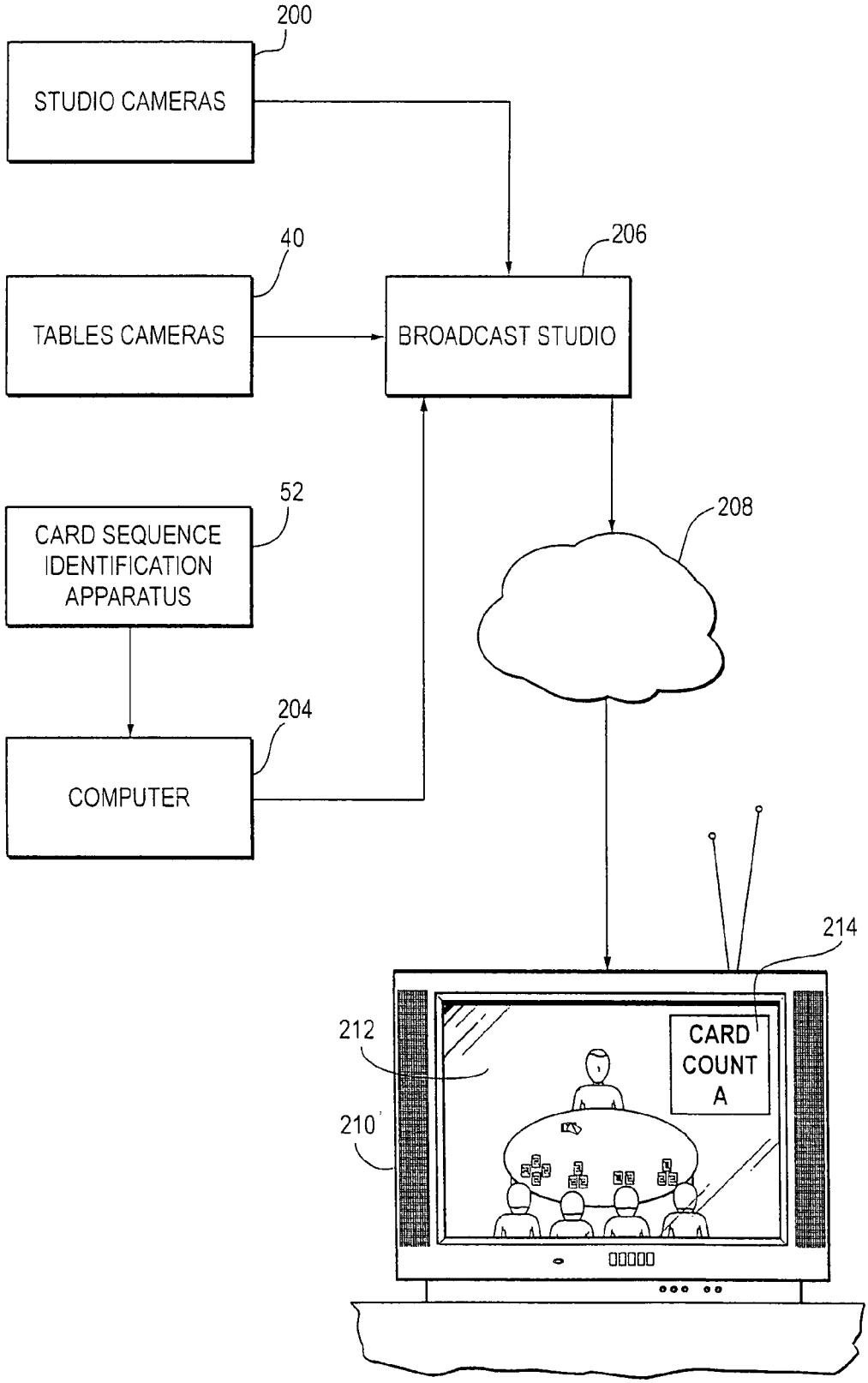
FIG. 6 is a schematic representation of one possible arrangement of the apparatus used in generating a broadcast video signal of a tournament as described herein.

FIG. 6 is a block diagram showing the apparatus which may be used to generate a broadcast of a tournament in accordance with one possible embodiment of this invention. The apparatus includes studio cameras and voice recording equipment 200 which capture voice and video of the host of the tournament program and experts on blackjack who provide commentary on the play. The apparatus further includes cameras 40 which are present at the tournament tables to capture video and sound of the play of the game and the cards dealt to the players. The apparatus further includes the card sequence identifying apparatus 52 which may take the form of the bar code reader 52 shown in FIG. 4. The apparatus further includes a computer 204 which receives the bar code data from the bar code reader and converts the bar codes to card values. The computer 204 is programmed to compute card counting reports as shown in FIGS. 2 and 3.

The audio/video feed from the studio cameras and voice recording equipment 200 and the table cameras 40 are fed to a broadcast production studio 206 for mixing and editing to generate a broadcast signal for distribution over an entertainment network 208. Further, the computer 204 provides card count reports and card sequence data to the broadcast production studio 206 for mixing, editing and addition to the broadcast signal. The resulting broadcast signal, typically in digital format, is generated at the studio and stored in a memory (not shown).

The broadcast signal is then distributed via the entertainment network 208 to viewers. The entertaining network 208 may take the form of a cable television network, Internet, or other network. The tournament can be viewed on a television set 210 having a display 212. The display 212 includes video of the tournament play captured by the cameras 40 at the tables, voice over commentary by experts captured by the studio camera and voice recording equipment 200, and video data comprising superimposed card counting reports 214 or card sequence data for cards remaining in the deck.

The details on generation of television programming are of course known to persons skilled in the art of television broadcasting and further explanation is deemed unnecessary in order to not obfuscate the present disclosure.

Since many modifications, variations, and changes in detail can be made to the described embodiments, it is intended that all matters in the foregoing description and shown in the accompanying drawings be interpreted as illustrative and not in a limiting sense. Further, it is intended to be understood that the following clauses further describe aspects of the present application.

(1) A method for conducting a blackjack tournament, comprising:

providing a pool of prize money for paying out to one or more winners of the tournament;

providing a set of rules for playing rounds of blackjack at the tournament wherein the rules are favorable to counting of cards by the players; and conducting rounds of play of blackjack using the set of rules wherein during the rounds of play the players make wagers and receive winnings with chips provided by the proprietor of the tournament to the players, whereby the proprietor of the tournament is not exposed to losses due to card counting by players playing in the tournament and card counting by the players may be encouraged.

(2) The method of clause (1), wherein the tournament is played at a plurality of tables and wherein the set of rules comprises a first rule of playing blackjack at the tables using a single deck of 52 cards and a second rule of dealing the cards from the deck of 52 cards down to the last card in the deck.

(3) The method of clause (1) or (2), wherein the tournament is played at a plurality of tables and wherein the set of rules comprises a rule of exposing all the cards of the players at each table to all the players at the table after each hand of play.

(4) The method of clause (1), (2) or (3), wherein the tournament is played at a plurality of tables and wherein the set of rules comprises a rule of exposing the cards of players who bust during play to all the players at each table.

(5) The method of clause (1), (2), (3) or (4), wherein the method further comprises the step of:

broadcasting the play of the tournament over an entertainment network;

identifying the sequence of cards yet to be dealt to players and the dealer during play and including the sequence in the broadcasting of the play; and providing a card counting report in the broadcast of the play.

(6) The method of clause (5), further comprising the step of including in the broadcasting of play commentary by one or more experts in the game of blackjack.

(7) The method of clause (5) or (6), wherein the entertainment network comprises a television network.

(8) The method of clause (5), (6) or (7), wherein the entertainment network comprises the Internet.

(9) A method for conducting a blackjack tournament, the tournament comprising play occurring at one or more blackjack tables where players in the tournament play against a dealer, the method comprising the steps of:

forming a pool of prize money for paying out to one or more winners of the tournament at least in part from entrance fees paid by one or more players playing in the tournament, sponsors of the tournament, or other sources;

providing a set of rules for playing rounds of blackjack at the tournament wherein the rules comprises a first rule of playing blackjack at each of the tables used in the tournament using a single deck of 52 cards and a second rule of dealing the cards from the deck down to the last card in the deck; and conducting rounds of play of blackjack at the tables using the set of rules wherein during the rounds of play the players make wagers and receive winnings with chips provided by the proprietor of the tournament to the players, whereby the proprietor of the tournament is not exposed to losses due to card counting by players playing in the tournament and card counting by the players may be encouraged.

(10) The method of clause (9), wherein the set of rules comprises a further rule allowing a player in the tournament to purchase a current card counting report with chips currently held by the player.

(11) The method of clause (9) or (10), wherein the set of rules comprise a further rule of exposing the cards of players who bust during play.

(12) The method of clause (9), (10) or (11), wherein the method further comprises the step of:

broadcasting the play of the tournament over an entertainment network;

identifying the sequence of cards yet to be dealt to players and the dealer during play and including the sequence in the broadcasting of the play such that it may be viewed by a view of the broadcasting; and providing a card counting report in the broadcast of the play.

(13) The method of clause (12), further comprising the step of including in the broadcasting of play commentary by one or more experts in the game of blackjack.

(14) The method of clause (12) or (13), wherein the entertainment network comprises a television network.

(15) Blackjack tournament apparatus comprising, in combination:

a facility hosting a tournament of blackjack, the facility including one or more tables where blackjack may be played;

one or more video cameras for capturing play at at least one of the one or more tables for broadcast to an audience remote from the facility;

wherein the tournament is characterized in that a pool of prize money is formed for paying out to one or more winners of the tournament;

a set of rules is provided for play at the tournament for playing rounds of blackjack at the tournament wherein the rules include one or more rules favorable to counting of cards in a systematic method for playing blackjack; and rounds of play of blackjack are conducted at the tables using the set of rules wherein during the rounds of play the players make wagers and receive winnings with chips provided by the proprietor of the tournament to the players, whereby the proprietor of the tournament is not exposed to losses due to card counting by players playing in the tournament and card counting by the players may be encouraged.

(16) The apparatus of clause (15), wherein the broadcast includes an identification of the sequence of one or more cards remaining in a deck of cards used at one of the tables; and a card counting report.

(17) The apparatus of clause (15) or (16), wherein the broadcast includes commentary by one or more experts in the game of blackjack.

(18) The apparatus of clause (15), (16) or (17), wherein the set of rules include a first rule of playing blackjack at each of the tables used in the tournament using a single deck of 52 cards and a second rule of dealing the cards from the deck down to the last card in the deck

(19) The apparatus of clause (15), (16), (17) or (18), wherein the apparatus further comprises card sequence identifying apparatus for determining the sequence of cards to be dealt by a dealer to players at one of the tables.

(20) The apparatus of clause (19), wherein the card sequence identifying apparatus comprises a machine readable code applied to the cards to be dealt by a dealer and a reader for the code.

(21) Television broadcast apparatus comprising:

a machine readable memory storing broadcast data for transmission over an entertainment network, the broadcast data comprising data representing video of play at a blackjack tournament, a card counting report reflecting the state of a deck of cards used in the tournament, and commentary by experts.

(22) The television broadcast apparatus of clause (21), wherein the broadcast data further comprises a sequence of one or more cards remaining in a deck of cards used at the tournament.

While a number of exemplary aspects and embodiments have been discussed above, those of skill in the art will recognize certain modifications, permutations, additions and sub-combinations thereof are present in this disclosure. It is therefore intended that the following appended claims and claims hereafter introduced are interpreted to include all such modifications, permutations, additions and sub-combinations as are within their true spirit and scope.

I claim:

1. A method for conducting a blackjack tournament that facilitates card counting, comprising:

providing a pool of prize money for paying out to one or more winners of the tournament;

providing a set of one ore more rules for playing rounds of blackjack at the tournament wherein the one or more rules are favorable to counting of cards by the players, the one or more rules including at least a rule that, for each round of play, all the cards played in the round of blackjack are revealed to all the players playing in the round, including the cards held by a player that busts during the round, and a rule providing players in the tournament with an option to purchase a current card counting report during play, wherein the card counting report comprises an index or score resulting from a systematic card counting method providing guidance to the player for play of the round;

automatically generating current card counting reports which are available to the players during the course of play with a programmed computer; and conducting rounds of play of blackjack using the set of rules wherein during the rounds of play the players make wagers and receive winnings with chips provided by the proprietor of the tournament to the players.

2. The method of claim 1, wherein the tournament is played at a plurality of tables and wherein the set of rules further comprise a rule of playing blackjack at the tables using a single deck of cards and a rule of dealing the cards from the deck of cards down to the last card in the deck.

3. The method of claim 1, wherein the method further comprises the step of:

broadcasting the play of the tournament over an entertainment network;

identifying the sequence of cards yet to be dealt to players and the dealer during play and including the sequence in the broadcasting of the play; and providing a card counting report in the broadcast of the play.

4. The method of claim 3, further comprising the step of including in the broadcasting of play commentary by one or more experts in the game of blackjack.

5. The method of claim 3, wherein the entertainment network comprises a television network.

6. The method of claim 3, wherein the entertainment network comprises the Internet.

7. A method for conducting a blackjack tournament that facilitates card counting, the tournament comprising play occurring at one or more blackjack tables where players in the tournament play against a dealer, the method comprising the steps of:

forming a pool of prize money for paying out to one or more winners of the tournament at least in part from entrance fees paid by one or more players playing in the tournament, sponsors of the tournament, or other sources;

providing a set of one or more rules for playing rounds of blackjack at the tournament wherein the one or more rules comprises a first rule of playing blackjack at each of the tables used in the tournament using a single deck of cards, a second rule of dealing the cards from the deck down to the last card in the deck, a third rule that, for each round of play, all the cards played in the round of blackjack at each of the tables are revealed to all the players playing in the round at the table, including the cards held by a player that busts during the round, and a fourth rule providing players in the tournament with an option to purchase a current card counting report during play, wherein the card counting report comprises an index or score resulting from a systematic card counting method providing guidance to the player for play of the round;

automatically generating current card counting reports which are available to the players with a programmed computer during the course of play; and conducting rounds of play of blackjack at the tables using the set of rules wherein during the rounds of play the players make wagers and receive winnings with chips provided by the proprietor of the tournament to the players.

8. The method of claim 7, wherein the current card counting report is purchasable with chips currently held by the player.

9. The method of claim 7, wherein the method further comprises the step of:

broadcasting the play of the tournament over an entertainment network;

identifying the sequence of cards yet to be dealt to players and the dealer during play and including the sequence in the broadcasting of the play such that it may be viewed by a viewer of the broadcasting; and providing a card counting report in the broadcast of the play.

10. The method of claim 9, further comprising the step of including in the broadcasting of play commentary by one or more experts in the game of blackjack.

11. The method of claim 9, wherein the entertainment network comprises a television network.

* * * * *